United States Patent [19]

Mowbray

[11] 4,359,995

[45] Nov. 23, 1982

[54] FUEL INJECTION PUMPING APPARATUS

[75] Inventor: Dorian F. Mowbray, Burnham, England

[73] Assignee: Lucas Industries Limited, Birmingham, England

[21] Appl. No.: 217,466

[22] Filed: Dec. 17, 1980

[30] Foreign Application Priority Data

Jan. 29, 1980 [GB] United Kingdom ..... 8003015

[51] Int. Cl.[3] ..... F02M 39/00

[52] U.S. Cl. ..... 123/502; 123/501

[58] Field of Search ..... 123/502, 501; 417/462

[56] References Cited

U.S. PATENT DOCUMENTS

| | | | |
|---|---|---|---|
| 2,125,210 | 7/1938 | Trapp | 123/501 |
| 2,910,975 | 11/1959 | Evans | 123/502 |
| 3,943,902 | 3/1976 | Skinner | 123/502 |
| 4,050,432 | 9/1977 | Davis et al. | 123/502 |
| 4,074,667 | 2/1978 | Skinner | 123/502 |
| 4,224,916 | 9/1980 | Davis | 123/502 |

FOREIGN PATENT DOCUMENTS

| | | | |
|---|---|---|---|
| 2047922 | 12/1980 | United Kingdom | 123/502 |

*Primary Examiner*—Ira S. Lazarus
*Assistant Examiner*—Magdalen Moy

[57] ABSTRACT

A fuel injection pumping apparatus comprises an injection pump including an angularly movable cam ring connected to a piston. Resilient means bias the piston against the action of a fluid pressure which varies in accordance with speed. A cam plate engages an abutment for the resilient means and is adjustable by means of a pivotal lever the setting of which is varied in accordance with the amount of fuel supplied by the apparatus thereby to vary the setting of the cam plate. The fulcrum for the lever is adjustable in accordance with the speed by means of a further piston responsive to said fluid pressure.

4 Claims, 3 Drawing Figures

FUEL INJECTION PUMPING APPARATUS

This invention relates to liquid fuel injection pumping apparatus for supplying fuel to an internal combustion engine and of the kind comprising an injection pump operable in use, to deliver fuel in timed relationship to an engine, a fuel supply pump for delivering fuel to the injection pump, valve means for controlling the output pressure of the fuel supply pump so that it varies in accordance with the speed at which the apparatus is driven, means for varying the amount of fuel delivered by the injection pump and a piston responsive to the output pressure of the supply pump and movable in response to pressure variation to vary the timing of fuel delivery by the injection pump.

Such apparatus is well known in the art and it is known to modify the timing in accordance with the amount of fuel being delivered by the injection pump. In this manner the timing of delivery of fuel to the engine is responsive to the load on the engine. It has been proposed to modify the timing in accordance with the load by developing a fluid pressure which varies in accordance with the amount of fuel being supplied by the supply pump to the injection pump. Such systems often involve the provision of restrictions in the fuel flow path between the supply path and the injection pump and can impair the filling of the injection pump at high fuel flow rates. Moreover, the variation in pressure which is obtained as a result of the variation in load, is comparatively low and it is not easy to construct a mechanism which is sufficiently responsive to this pressure variation.

The object of the present invention is to provide an apparatus of the kind specified in a simple and convenient form.

According to the invention an apparatus of the kind specified comprises resilient means for opposing the movement of the piston, an abutment for said resilient means, a cam plate movable to vary the position of said abutment, a pivotal lever connecting said cam plate with a link the setting of which varies in accordance with the amount of fuel delivered by the injection pump, an adjustable fulcrum for said pivotal lever and speed responsive means for adjusting the setting of said fulcrum.

An example of a fuel injection pumping apparatus in accordance with the invention will now be described with reference to the accompanying drawings in which.

Figure 1:
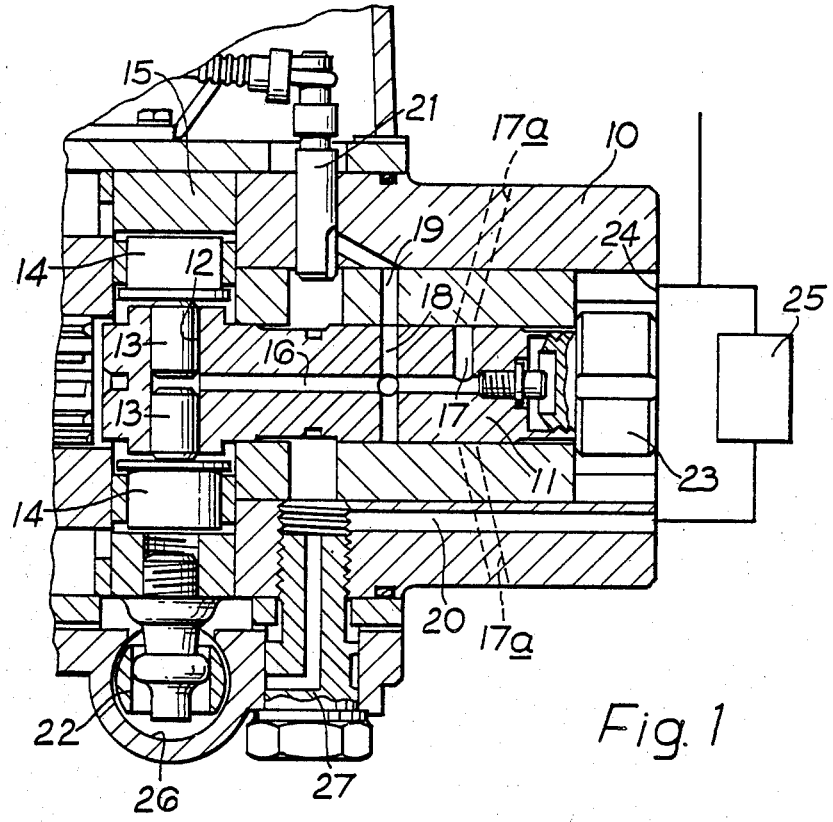
FIG. 1 is a part sectional side elevation of the apparatus.

Referring to FIG. 1 of the drawings the apparatus comprises a body 10 in which is mounted a rotary cylindrical distributor member 11. The distributor member is connected to a shaft whereby it can be driven in timed relationship with an associated engine and formed in the distributor member is a transversely extending bore 12 in which is mounted a pair of plungers 13. The plungers 13 at their outer ends, engage cam followers 14 which include rollers respectively engageable with the internal peripheral surface of an angularly adjustable cam ring 15.

The bore 12 communicates with a longitudinal passage 16 formed in the distributor member and this communicates with a radially extending delivery passage 17. This passage can communicate in turn as the distributor member rotates, with a plurality of outlets 17*a* formed in the body and which in use are connected to the injection nozzles respectively of the associated engine. The passage 16 also communicates with a plurality of radially disposed inlet passages 18 which are adapted to register with an inlet port 19 formed in the body part. Also located in the body part is a fuel control means in the form of a throttle member 21 through which fuel flowing through a passage 20 can flow to the inlet port 19.

The passage 20 communicates with the outlet of a low pressure supply pump 23 which has an inlet 24. The rotary part of the supply pump is driven from the distributor member 11 and the inlet and outlet of the supply pump are interconnected by a relief valve 25 which acts to control the output pressure so that it varies in accordance with the speed at which the apparatus is driven.

The plungers 13 constitute the pumping elements of an injection pump and with the setting of the distributor member as shown in FIG. 1, fuel is being supplied from the supply pump 23 by way of the passage 20, the throttle member 21 and the inlet port 19, to the bore 12. As the distributor member rotates communication of the inlet port with one of the inlet passages is broken and the passage 17 moves into register with one of the outlets 17*a*. Inward movement is now imparted to the plungers by way of the cam followers 14, by means of cam lobes formed on the internal peripheral surface of the cam ring and as the plungers move inwardly, fuel is displaced through an outlet 17*a* to an associated nozzle. The cycle is repeated as the distributor member is further rotated and the quantity of fuel which is supplied to the engine is determined by the setting of the throttle member 21.

In order to vary the timing of delivery of fuel by the injection pump to the associated engine a component of the injection pump is adjustable, and in this case the component is the cam ring 15 which is angularly adjustable within the body and which for this purpose is connected by means of a radially disposed peg, to a piston 22 which is located within a cylinder 26 which is formed in a part secured to the body by means of a bolt 27 which also serves to provide a fuel connection from the passage 20. A check valve 27A(FIG. 2) is incorporated in the connection between the passage 20 and the cylinder 26. The valve acts to prevent movement of the piston 22 when a reaction force is applied to the cam ring by the engagement of the rollers 14 with the cam lobes.

Figure 2:
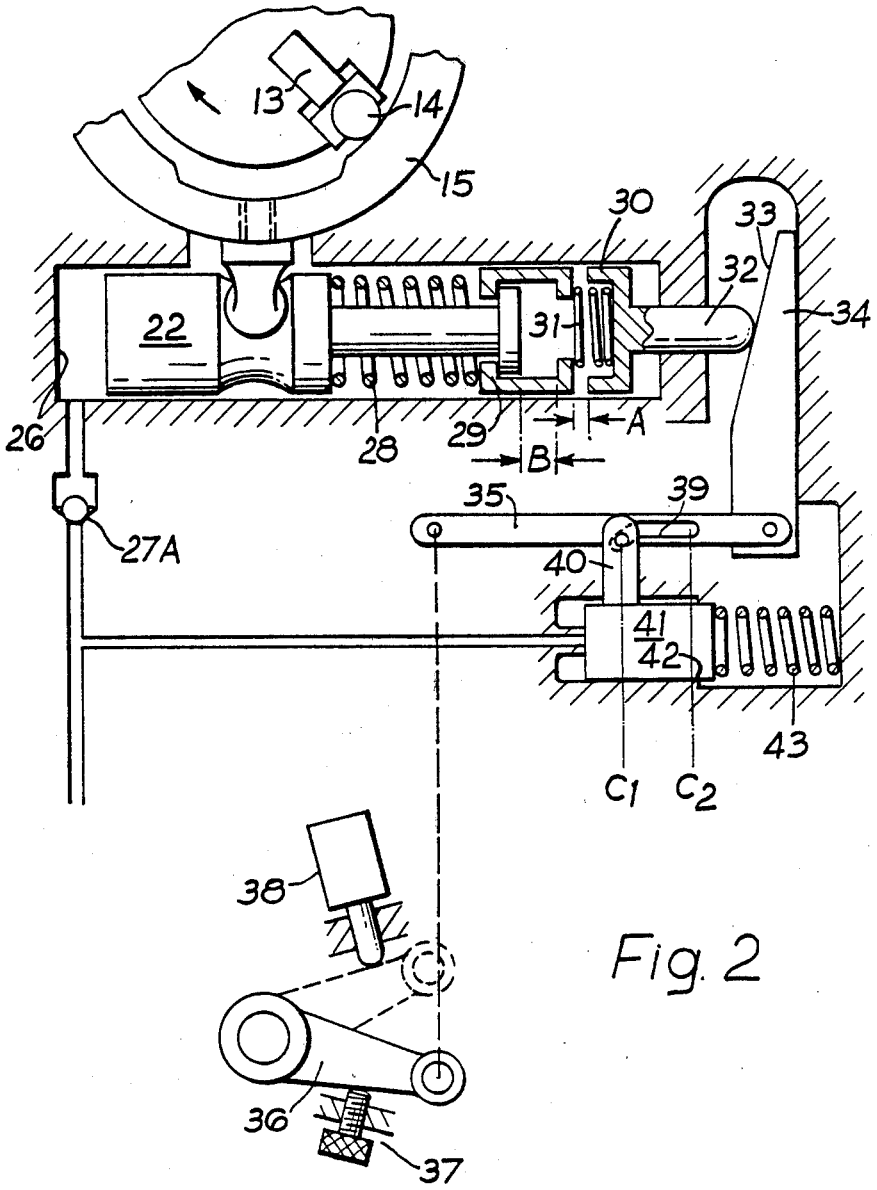
FIG. 2 is a diagrammatic illustration of part of the apparatus seen in FIG. 1 together with parts not seen in FIG. 1.

Turning now to FIG. 2, resilient means in the form of a coiled compression spring 28 is provided and this engages the piston at one end and at its other end an abutment 29. The piston is also provided with an extension which has a flange engageable with the abutment under the action of the spring 28. A further abutment 30 is provided and a light spring 31 is disposed between the two abutments. The abutment 30 has an extension 32 the end of which is engageable with a cam profile 33 formed on a cam plate 34 which is movable relative to the axis of movement of the piston 22. The cam plate is pivotally connected to one end of a lever 35 the other end of which is pivotally connected to a lever 36 angularly movable with the throttle member 21. A pair of stops are provided to limit the angular movement of the lever 36, one of the stops namely that which is referenced 37, determining the maximum rate of fuel flow to the engine whilst the other stop referenced 38 determines the minimum fuel flow to the engine and therefore sets the idling speed. Conveniently this stop is responsive to the temperature of the associated engine so that for idling purposes when the engine is cold, more fuel will be supplied to the engine than when it is hot.

The lever 35 has an adjustable fulcrum and for this purpose it is provided with a slot 39 in which is located a pin carried by a peg 40 upstanding from a piston 41 slidable within a cylinder. The axis of movement of the piston 41 is parallel to that of the piston 22 and the piston is biassed towards one end of the cylinder 42 in which it is located, by means of a coiled compression spring 43. The one end of the cylinder is in communication with the outlet of the supply pump and conveniently the piston 41 co-operates with the outlet to form a valve such that when the piston 41 is moved its maximum extent under the action of the spring 43, only a small area of the piston 41 is exposed to the outlet pressure of the supply pump. When this pressure becomes sufficiently high, and the piston 41 starts to move the whole of its end surface becomes exposed to the pressure and the piston moves to its alternative position, the stroke of the piston being indicated by the letters C1–C2.

In the position shown in FIG. 2, the lever 36 is in the maximum fuel position and it is arranged that the lever 35 and in particular the slot 39, extends parallel to the axis of movement of the pistons 22 and 41.

Figure 3:
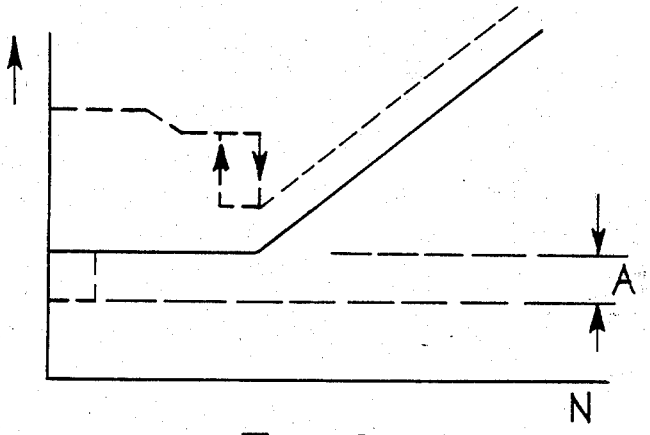
FIG. 3 is a graph illustrating the advance/speed characteristics of the apparatus shown in FIGS. 1 and 2.

Reference will now be made to FIG. 3 and considering first of all the situation when the lever 36 is in the maximum fuel position. In this setting the position of the piston 41 has no effect upon the cam plate 34 and prior to the engine starting, the abutment 29 is separated from the abutment 30 by means of the spring 31. The extent of separation is determined by means not shown and the actual distance is indicated in FIG. 2 by the letter A. The position of the pistion 22 is such that the timing of delivery of fuel to the engine is fully retarded. When the engine is started the pressure acting on the piston 22 moves the abutment 29 towards the abutment 30 against the action of the spring 31 and thereafter there follows a period during which no movement of the piston 22 takes place because the spring 28 is a preloaded spring. When the force applied to the piston 22 is sufficient, the preload of the spring 28 is overcome and the timing of delivery of fuel to the engine advances, the characteristic being that indicated by the full line in FIG. 3.

If the lever 36 is in contact with the stop 38 then the lever 35 will be at a position clockwise relative to the position shown in FIG. 2 and the cam plate 34 will be moved downwardly. When the engine is at rest the abutments 29 and 30 will be separated as previously described by the spring 31. As soon as the engine is started this spring is overcome and the timing of delivery advanced as previously described. Because of the cam surface 33, the timing of delivery is further advanced as compared with the situation when the lever 36 is in the maximum fuel position. Moreover, if initially the engine is cold the degree of advance will be less than when the engine is hot and as the device 38 responds to an increase in engine temperature, the degree of advance will increase. This is shown by the initial portion of the dash line in FIG. 3.

When the lever 36 is in the minimum fuel position the lever 35 is no longer parallel to the axis of movement of the piston 41 and hence movement of the piston 41 will have an effect upon the position of the cam plate 34. As explained, the piston 41 provides a differential effect and as the engine speed increases the timing of delivery will follow the portion of the curve indicated by the downward arrow. As the speed decreases then the timing follows the upward arrow. Thus when the piston 41 starts to move towards the right against the action of the spring 43 there will be an upward movement of the cam plate 34 and hence a retarding in the timing of delivery of fuel to the engine. It is arranged that when the engine is started from rest, the piston 41 starts to move at substantially the same time as the piston 22 but when the engine speed is falling, the piston 41 will not return under the action of the spring 43 until the pressure, i.e. speed, has fallen by an additional amount.

The apparatus described can be modified in a number of ways for example, the piston 41 can be a conventional piston that is to say it does not act as a differential piston, and the spring 43 may have a controlled rate. As an alternative, the variation in timing which is effected by means of the movement of the plate 34 can be non-linear, this being arranged by a suitable variation in the profile of the cam surface 33. Furthermore, the slot 39 may have a varying profile throughout its length so that non-linear variation of the timing of delivery takes place as the piston 41 is moved. In the example the cam plate 34 is movable in a direction at a right angle to the axis of rotation of the distributor member.

I claim:

1. A liquid fuel injection pumping apparatus for supplying fuel to an internal combustion engine and of the kind comprising an injection pump operable in use, to deliver fuel in timed relationship to an engine, a fuel supply pump for delivering fuel to the injection pump, valve means for controlling the output pressure of the fuel pump so that it varies in accordance with the speed at which the apparatus is driven, means for varying the amount of fuel delivery by the injection pump, a piston responsive to the output pressure of the supply pump and movable in response to pressure variation to vary the timing of fuel delivered by the injection pump, resilient means for opposing the movement of the piston, an abutment for said resilient means, a cam plate movable to vary the position of said abutment, a pivotal lever connecting said cam plate with a link the setting of which varies in accordance with the amount of fuel delivered by the injection pump, an adjustable fulcrum for said pivotal lever and speed responsive means for adjusting the setting of said fulcrum including a further piston operably connected to said fulcrum, said further piston being responsive to the output pressure of said supply pump and further resilient means biasing said further piston.

2. An apparatus according to claim 1, in which said pivotal lever is provided with an axial slot, said fulcrum comprising a pin located in said slot and said pin being carried by a peg on said further piston.

3. An apparatus according to claim 1, in which said further piston is a differential piston.

4. An apparatus according to any one of claims 1, 2 or 3, in which said resilient means comprises first and second coiled compression springs, the first of said springs being a preloaded spring.

* * * * *